US009708837B2

(12) United States Patent
Bendel et al.

(10) Patent No.: US 9,708,837 B2
(45) Date of Patent: Jul. 18, 2017

(54) MOTOR VEHICLE DOOR LOCK

(71) Applicant: Kiekert Aktiengesellschaft, Heiligenhaus (DE)

(72) Inventors: Thorsten Bendel, Oberhausen (DE); Armin Handke, Duisburg (DE); Matthias Ochtrop, Dorsten (DE); Matthias Kellersohn, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 188 days.

(21) Appl. No.: 14/374,049

(22) PCT Filed: Jan. 24, 2013

(86) PCT No.: PCT/DE2013/000042

§ 371 (c)(1),
(2) Date: Jul. 23, 2014

(87) PCT Pub. No.: WO2013/110262

PCT Pub. Date: Aug. 1, 2013

(65) Prior Publication Data

US 2014/0361555 A1 Dec. 11, 2014

(30) Foreign Application Priority Data

Jan. 26, 2012 (DE) ..... 20 2012 000 763 U

(51) Int. Cl.
*E05C 3/16* (2006.01)
*E05B 85/00* (2014.01)
(Continued)

(52) U.S. Cl.
CPC ..... *E05B 85/00* (2013.01); *E05B 77/34* (2013.01); *E05B 15/1607* (2013.01); *Y10T 292/48* (2015.04)

(58) Field of Classification Search
CPC ..... E05B 77/34; E05B 77/36; E05B 77/38; E05B 85/00; E05B 85/02; E05B 15/1607
(Continued)

(56) References Cited

U.S. PATENT DOCUMENTS 3,439,948 A * 4/1969 Smith ..... E05B 83/16 292/216
4,691,958 A * 9/1987 Miller ..... E05C 17/50 292/262
(Continued)

FOREIGN PATENT DOCUMENTS

DE 86 17 143 U1 9/1986
DE 0 510 843 A1 10/1992
(Continued)

OTHER PUBLICATIONS

Computer-Generated Translation for JP H06-073273 U, translation retrieved on Mar. 23, 2016, https://www4.j-platpat.inpit.go.jp/eng/tokujitsu/tkbs_en/TKBS_EN_GM 101_Top.action.*
(Continued)

*Primary Examiner* — Alyson M Merlino
(74) *Attorney, Agent, or Firm* — Renner, Otto, Boisselle & Sklar, LLP

(57) ABSTRACT

The invention relates to a motor vehicle door lock, comprising a lock housing (1) and at least one lever (2) that is arranged in the lock (1) and projects through an opening (4) at least partially out of the lock (1), wherein the lever (2) is formed as a pivot lever (2) which is movable along the opening (4) and mounted in the interior and/or on the lock housing (1) and the opening (4) is equipped with at least one seal (6) that, for the most part, closes an opening gap (5).

9 Claims, 1 Drawing Sheet

(51) Int. Cl.
*E05B 77/34* (2014.01)
*E05B 9/00* (2006.01)
*E05B 15/16* (2006.01)

(58) Field of Classification Search
USPC ..... 277/644, 648
See application file for complete search history.

(56) References Cited

U.S. PATENT DOCUMENTS

| | | | | |
|---|---|---|---|---|
| 4,735,447 | A * | 4/1988 | Kleefeldt | E05B 81/06 292/201 |
| 4,885,954 | A * | 12/1989 | Wanlass | E05B 81/25 250/227.12 |
| 5,088,347 | A * | 2/1992 | Wanlass | E05B 81/25 192/84.951 |
| 5,762,384 | A * | 6/1998 | Bartel | E05B 77/48 292/201 |
| 6,375,234 | B1 * | 4/2002 | Brackmann | E05B 77/34 292/1 |
| 6,393,767 | B1 | 5/2002 | Fukumoto et al. | |
| 6,415,636 | B1 * | 7/2002 | Fukumoto | B60J 5/0412 292/336.3 |
| 6,422,619 | B1 * | 7/2002 | Arabia, Jr. | E05B 77/34 292/337 |
| 6,497,436 | B1 | 12/2002 | DeBlock et al. | |
| 6,552,659 | B1 | 4/2003 | Waltz et al. | |
| 8,936,284 | B2 * | 1/2015 | Konchan | E05B 81/90 292/201 |
| 9,106,114 | B2 * | 8/2015 | Bendel | E05B 81/20 |
| 2009/0322119 | A1 | 12/2009 | Fannon et al. | |

FOREIGN PATENT DOCUMENTS

| | | | |
|---|---|---|---|
| DE | 197 28 967 | A1 | 1/1999 |
| DE | 100 13 848 | A1 | 9/2001 |
| EP | 1 030 014 | A1 | 8/2000 |
| FR | 2 810 095 | A1 | 12/2001 |
| JP | H06 73273 | U | 10/1994 |

OTHER PUBLICATIONS

International Search Report and English translation for corresponding patent application No. PCT/DE2013/000042 dated Jun. 19, 2013.

* cited by examiner

MOTOR VEHICLE DOOR LOCK

FIELD OF THE INVENTION

The invention relates to a motor vehicle door lock, comprising a lock housing and at least one lever that is arranged in the lock housing and protrudes or projects through an opening in the lock housing at least partially out of the lock housing, wherein the lever is formed as a pivot lever which is movable along the opening and mounted in the interior of the lock housing.

BACKGROUND OF THE INVENTION

Motor vehicle door locks of the above design, as commonly used in industry and which are, for instance, described in the generic DE 35 26 501 A1, typically contain an arrangement in which an external actuation lever, an external locking lever or also other levers such as internal actuation levers, internal locking levers, etc. extend to the outside through associated openings in the lock housing. This is necessary as said levers are generally mechanically coupled to manipulation elements arranged remotely from the motor vehicle door lock in a motor vehicle door via interposed connecting elements such as Bowden cables, rods or similar.

The external actuation lever is, for instance, mechanically coupled to an external door handle, arranged remotely from the lock housing on the outside of a motor vehicle door. The external locking lever may be mechanically coupled to a locking cylinder provided in an area of the external door handle.

An additionally provided internal door handle acts on the internal actuation lever and an internal locking head is mechanically connected to the internal locking lever in the shown example. Although some of these individual functions have nowadays at least partially been automated by a motor provided inside the lock housing being respectively electrically controlled from the outside, one or more levers still extend through associated openings out of the lock housing. This is due to safety reasons and in order to provide a required back-up ensuring the main functions of the motor vehicle door lock also in case of an electrical fault.

Such openings in the lock housing are problematic, as regards the service life of the motor vehicle door lock and its unchanged functionality. The opening allows dust, dirt and humidity to enter the inside of the motor vehicle door lock. In extreme cases this can cause corrosion which cannot only impair functionality but stop its functioning altogether.

Further prior art as disclosed in DE 199 20 278 A1 shows approaches to tightly seal the lock housing. For this purpose, the lock housing of this prior art embodiment is fully enclosed. In addition, associated operating elements are all located outside of the lock housing and interact with closing elements and/or locking/actuating elements via connecting elements mounted in the lock housing. This means that by relying on obligatory connecting elements between the actuating elements and the closing elements or locking/actuating elements, a relative complex and expensive design is required. This arrangement also lacks flexibility at this point as a separate design must be developed and implemented for each motor vehicle door lock or associated lock housing.

In further prior art the lock housing already contains an integral seal. In this context, EP 0 940 241 A2 discloses a method for producing a lock housings with an integral seal, produced from a plastic material by injection moulding. The problem of the required openings for levers projecting out of the lock housing is, however, not mentioned at this point.

The same applies for the composite element made from thermoplastic and polyurethane elastomer with the addition of a bonding agent, disclosed in DE 198 58 270 A1. This composite element can also be a door lock housing with sealing lips, without the position and arrangement of the sealing lips being disclosed in detail.

SUMMARY OF THE INVENTION

The invention is therefore based on the technical problem of developing a motor vehicle door lock of the aforementioned design in such a way that service life and functional reliability are improved and that, in particular, ingress of dirt in the area of the opening is prevented or at least reduced.

To solve this technical problem, a generic motor vehicle door lock of the invention is characterized by the opening containing a seal closing most of the opening gap.

This means that the opening or the opening gap inevitably provided at this point are mainly closed off by a seal in the invention. In this way the opening gap as such can be closed or there is at least the option to significantly reduce the size of the opening gap in comparison to prior art embodiments.

In order to achieve this, the at least one seal is connected to the opening and is, for instance, glued to the opening rim. In this case, the seal is thus retrospectively connected to the opening rim, using an adhesive. Alternatively or in addition, the seal but also the opening rim can be pointed. This arrangement is used in most cases. Naturally also other methods of coupling the seal to the opening rim are part of the invention, such as a coupling using clips or snapping into place.

Generally and, according to a preferred arrangement, the seal is, however, injection moulded to the opening rim. In this case the seal is, for instance, a foil seal injection moulded to the opening rim, i.e. a thinner seal with foil-like properties. As a result, the seal can mainly be designed in such a way that it fully seals the opening gap and that only the lever or pivot lever projecting from the opening gap slightly deforms the seal.

Alternatively, the seal may not fully close off the opening gap and may only extend up to the lever projecting from the opening. In this case, generally two facing seals are used, containing an opening slit therebetween, between which the pivot lever can be moved to and fro. In this case, the clear width of the opening slit corresponds to the material thickness of the pivot lever or can be even thinner.

The opening through which the lever projects is generally predominantly rectangular. Consequently, the opening rim also forms a rectangle. The seal can be connected to one or both longitudinal edges of the opening. In the latter case, two opposed seals are used on the respective longitudinal edges of the rectangular opening rim. These two seals connected to the opposed longitudinal edges of the opening accommodate the lever centrally therebetween.

Naturally, also a different arrangement may be possible. The overall arrangement can be such that the seals define the already described opening slit within which the pivot lever can be moved to and fro. It is, however, also possible for the top edges of the seals to be abutting or even overlapping. In this case, the lever or respective pivot lever projecting through the seals, ensures that the seals are deformed by said lever. For this purpose, the one or several seals are in most cases made from an elastomer plastic.

In principle, the lock housing and the seal can be made from the same material. Such an arrangement has the advantage that the lock housing and the seal are produced in a joint single-component manufacturing process, i.e. by injection moulding plastic. In this case, the lock housing is at least in the area of the seal made from plastic as is the seal itself. The same but also different plastics may be used. In the latter arrangement, typically a so-called two- or even three-component injection moulding process is used, defining the lock housing including seal in a single manufacturing process.

In most cases, the lock housing will be produced from a thermoplastic material. The seal, on the other hand, is made from elastomer. Thermoplastics such as POM (polyoximethylene), PP (polypropylene), PE (polyethylene) or PA (polyamide) have proven to be advantageous for the lock housing. The seal is, in most cases, produced from an elastomer such as NBR (acrylonitrile butadiene rubber), EPDM (ethylene propylene-diene rubber), NR (natural rubber) or also SBR (styrene-butadiene rubber). For reasons of cost, the lock housing and the seal will typically be produced in a single production process. This may be a two-component injection moulding process.

As a result, a motor vehicle door lock is provided, containing a lock housing, whose at least one obligatory opening through which the pivot lever mounted in the lock housing projects, contains special sealing measures. Most of the opening gap required at this point is covered by a seal. The seal is typically made of elastomer and is or can be wholly or partly deformed by the lever projecting through said seal.

The elastomer seal and the lock housing can be produced together in a single manufacturing process, so that the costs of the lock housing are only slightly higher than those of a conventional lock housing. But at the same time an additional particular benefit is produced as elements housed inside the lock housing, in particular closing and locking elements etc., are particularly protected against ingress of dirt and water, etc. This significantly increases the service life of the motor vehicle door lock of the invention compared to prior art embodiments, thus basically ruling out any malfunctioning. These are the main advantages of the invention.

Below, the invention is explained in more detail with reference to a drawing showing only one embodiment, in which:

DETAILED DESCRIPTION OF THE INVENTION

The figures show a motor vehicle door lock containing a lock housing 1 and at least a lever 2 arranged in a lock housing 1. The lever 2 is an external locking lever 2, designed as a pivot lever 2, although the invention is not restricted to this. The pivot lever 2 is mounted inside or on the lock housing 1. The pivot lever 2 actually contains a rotation axis 3, defined by a pin inserted in the lock housing 1, on which the pivot lever 2 is swivel mounted.

Figure 1:
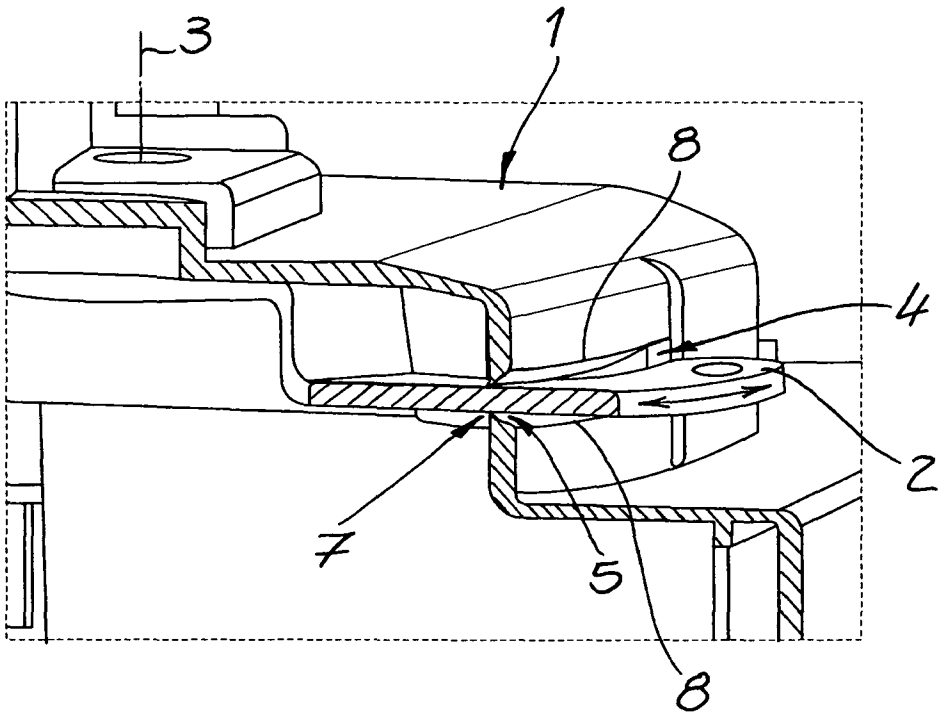

In the shown example, the lever or the pivot lever 2 in form of the external locking lever 2 is mechanically connected to a locking cylinder although the invention is not restricted to this. Closing movements on this locking cylinder correspond to the pivot lever 2 carrying out pivoting movements around the rotation axis 3 as shown by the double arrow on the pivot lever 2 indicated in FIG. 1. During this process, the lever or pivot lever 2 moves along an opening 4, through which the lever 2 projects out of the lock housing 1. In the example, an actuating rod—not shown—extending from the closing cylinder outside of the lock housing 1 is actually connected to said pivot lever 2.

The opening 4 in the lock housing 1 describes an associated opening gap 5, which according to the invention contains a seal 6 sealing most of the opening gap 5. It is apparent that the embodiment contains two opposing seals 6 accommodating the lever or pivot lever 2 mainly at their centre. Together the two seals 6 form an opening slit 7, completely filled by the lever or pivot lever 2 in the shown example (see FIG. 2).

The figures also show an opening rim 8 or longitudinal edges of the opening rim 8 to which the seals 6 are connected. The opening 4 is predominantly rectangular with the opening rim 8 being designed as an open rectangle. One seal 6 is in each case connected to the opposing longitudinal edges of the opening rim 8.

The seal 6 is in each case a foil seal injection moulded onto the opening rim 8. The foil seal 6 actually has a material thickness s, which in most cases is a fraction of the material thickness t of the lock housing 1 in the area of the opening rim 8. In the embodiment:

$t=1 \ldots 5\ s$, in particular $t=1 \ldots 3\ s$.

Naturally also other sizes are feasible. The lock housing 1 and the seal or the seals 6 can be made of the same material. In the shown example, the lock housing 1 and the seals 6 are, however, made of different materials.

At this point, different plastic is in fact used for lock housing 1 on one hand and seals 6 on the other hand. Whilst the lock housing 1 is predominantly made from thermoplastic, an elastomer is used for the seals. The lock housing 1 including the seals 6 is typically produced in a single production process. This can be achieved using a so-called two-component injection moulding process. Using this process, the seal 6 can be directly injection moulded to the opening rim 8 or the lock housing 1. The elastomer nature of the seals 6 ensures that the respective seal 6 can, where required, rest flexibly against pivot lever 2 which can be moved to and fro the opening 4.

Figure 2:
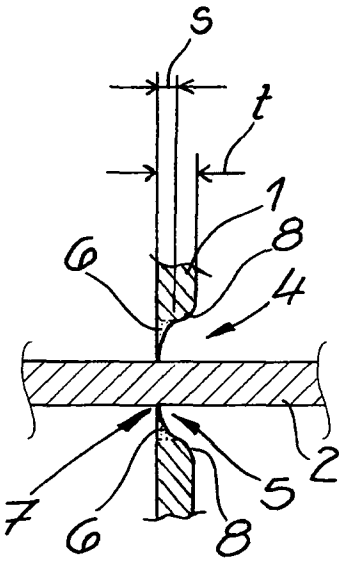
FIG. 1 shows a section of a motor vehicle door lock with a lock housing and a respective opening and FIG. 2 shows a schematic enlarged section through FIG. 1 in the area of the opening.

The example embodiment shows in fact an opening slit 7 between two opposing seals 6 essentially corresponding to the material thickness of the pivot lever 2 (see FIG. 2). This means that the respective front edges of the seals 6 abut against pivot lever 2. It is, however, also possible to make one or also both opposing seals 6 wider or longer, so that seal 6 is not—as shown—arranged edge to edge with the pivot lever 2, but is purposely deformed in the area of the surface of the pivot lever 2.

In principle it is even possible to work without any opening slit 7. In this case, the upper edges or folding edges of the seals 6 abut or even overlap. In this arrangement, the pivot lever 2 projecting through opening 4 causes a deformation of one or both seals 6. The two seals 6 ensure in any case that the obligatory opening 4 is fully or nearly fully closed, so that according to the invention any ingress of humidity, dirt, dust, etc. in the lock housing is reliably prevented.

The invention claimed is:

1. A motor vehicle door lock comprising a lock housing that defines an opening, and at least one lever that is arranged in the lock housing and projects at least partially out of the lock housing through the opening, wherein the at least one lever is formed as a pivot lever which is moveable along the opening and mounted in an interior and/or on the lock housing, wherein the housing has at least one opening rim that defines the opening, wherein the opening includes at least one gap formed between the at least one lever and the at least one opening rim, wherein the opening is equipped with at least one seal fixed to the at least one opening rim so as to at least partially close the at least one gap between the at least one lever and the at least one opening rim; and wherein the at least one seal comprises two seals, the at least one opening rim comprises two opposing longitudinal edges, and the at least one gap comprises two gaps, wherein each seal is fixed to a corresponding one of the longitudinal edges and extends into a corresponding one of the gaps perpendicularly to the at least one lever so as to accommodate the at least one lever centrally between them.

2. The motor vehicle door lock according to claim 1, wherein the at least one seal is designed as a foil injection moulded to the at least one opening rim.

3. The motor vehicle door lock according to claim 1, wherein the opening is predominantly rectangular with the at least one opening rim forming an open rectangle.

4. The motor vehicle door lock according to claim 1, wherein the lock housing and the at least one seal are made of the same material.

5. The motor vehicle door lock according to claim 1, wherein at least in an area of the opening the lock housing and the at least one seal are made of plastic.

6. The motor vehicle door lock according to claim 1, wherein the lock housing and the at least one seal are made of a different plastics.

7. The motor vehicle door lock according to claim 6, wherein the lock housing is made of a thermoplastic material and the at least one seal is made of an elastomer.

8. The motor vehicle door lock according to claim 1, wherein the lock housing and the at least one seal are produced in a single production process.

9. The motor vehicle door lock according to claim 1, wherein the at least one seal defines an opening slit equal to or thinner than a material thickness of the at least one lever.

* * * * *